US010600601B2

(12) United States Patent
Oh et al.

(10) Patent No.: US 10,600,601 B2
(45) **Date of Patent: *Mar. 24, 2020**

(54) TUNING FORK TERMINAL SLOW BLOW FUSE

(71) Applicant: Littelfuse, Inc., Chicago, IL (US)

(72) Inventors: Seibang Oh, Elk Grove, IL (US); Julio Urrea, Hudson, OH (US); James J. Beckert, Rolling Meadows, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/544,169

(22) Filed: Aug. 19, 2019

(65) Prior Publication Data

US 2019/0371558 A1 Dec. 5, 2019

Related U.S. Application Data

(63) Continuation of application No. 16/057,176, filed on Aug. 7, 2018, now Pat. No. 10,446,353, which is a continuation of application No. 12/712,596, filed on Feb. 25, 2010, now Pat. No. 10,192,704.

(60) Provisional application No. 61/155,969, filed on Feb. 27, 2009.

(51) Int. Cl.

| | |
|---|---|
| ***H01H 85/041*** | (2006.01) |
| ***H01H 85/147*** | (2006.01) |
| *H01H 85/143* | (2006.01) |
| *H01H 85/20* | (2006.01) |
| *H01H 85/045* | (2006.01) |

(52) U.S. Cl.

CPC ..... *H01H 85/0417* (2013.01); *H01H 85/147* (2013.01); *H01H 85/0452* (2013.01); *H01H 85/143* (2013.01); *H01H 85/2035* (2013.01); *H01H 85/2045* (2013.01)

(58) Field of Classification Search

CPC ..... H01H 85/0417; H01H 85/0452; H01H 85/143; H01H 85/147; H01H 85/2035; H01H 85/2045

See application file for complete search history.

(56) References Cited

U.S. PATENT DOCUMENTS

| | | | | |
|---|---|---|---|---|
| 3,909,767 A * | 9/1975 | Williamson | ..... | H01H 69/02 337/264 |
| 5,951,328 A * | 9/1999 | Roper, Jr. | ..... | H01H 85/2035 439/620.27 |
| 2009/0191731 A1* | 7/2009 | Lemke | ..... | H01R 12/57 439/83 |

* cited by examiner

*Primary Examiner* — Jacob R Crum

(57) ABSTRACT

A fuse including a housing having upper and lower portions, a plurality of terminal portions disposed in the lower portion, each of said terminal portions having first and second prongs and a gap therebetween, the gap narrowing from a first width adjacent an upper end of said first and second prongs to a second width adjacent a lower end of said first and second prongs, a fusible link disposed in the upper portion of the housing between said plurality of terminal portions, and a partition in said lower portion of said housing, wherein a distance between each of the second prongs and the partition increases from a first end of each of the second prongs proximate the upper portion to a second end of each of the second prongs distal from the upper portion for allowing the second ends to be displaced toward the partition before engaging the partition.

19 Claims, 8 Drawing Sheets

TUNING FORK TERMINAL SLOW BLOW FUSE

CROSS-REFERENCES TO RELATED APPLICATIONS

This application is a continuation of U.S. patent application Ser. No. 16/057,176, filed Aug. 7, 2018, which is a continuation of U.S. patent application Ser. No. 12/712,596, filed Feb. 25, 2010 and now is granted as U.S. Pat. No. 10,192,704 on Jan. 29, 2019, which claims priority to U.S. Provisional Application No. 61/155,969, which was filed on Feb. 27, 2009, the entire contents of which applications are incorporated herein by reference.

BACKGROUND OF THE INVENTION

Field of the Invention

Embodiments of the invention relate to the field of fuses. More particularly, the present invention relates to a one-piece tuning fork terminal design and a two piece housing which provides strain relief and overstress protection during insertion.

Discussions of Related Art

As is well known, a fuse (short for "fusible link") is an overcurrent protection device used in electrical circuits. In particular, when too much current flows, a fuse link breaks or opens thereby protecting the electrical circuit from this increased current condition. A "fast acting' fuse creates an open circuit rapidly when an excess current condition exists. A "time delay" fuse generally refers to the condition where the fuse does not open upon an instantaneous overcurrent condition. Rather, a time lag occurs from the start of the overcurrent condition which is needed in circuits used for motors which requires a current surge when the motor starts, but otherwise runs normally.

The terminals of a fuse may have a tuning fork configuration where a first prong is spaced from a second prong to accommodate insertion of a male or female terminal as disclosed in U.S. Pat. No. 6,407,657 the contents of which are hereby incorporated by reference. Each of the first and second prongs have a normal force toward the space formed therebetween which acts against the male receiving terminal to define an electrical connection. As these terminals are positioned within a fuse box, this normal force may degrade over time which compromises the electrical connection the terminal prongs and the male receiving terminal. In addition, the size, shape and composition of the terminals may limit the current capacity of the fuse. Moreover, the housing needs to be configured to limit the strain forces applied to the terminals and the fusible link during assembly, installation and operation. Thus, there is a need for an improved fuse employing tuning fork terminal configurations with an increased current capacity and a housing design to provide terminal insertion protection and strain relief.

SUMMARY OF THE INVENTION

Exemplary embodiments of the present invention are directed to a fuse which provides improved current capacity, strain relief and insert protection. In an exemplary embodiment, the fuse includes a plurality of conducting terminal portions having first and second prongs and a gap disposed therebetween. At least one of the terminal prongs has an upper end, a lower end and an angled wall disposed between the lower and upper end. The angled wall is configured to provide increased surface area of a first of the plurality of conducting terminal portions. A fusible link is disposed between the plurality of terminal portions where the fusible link is configured to interrupt current flowing between the plurality of terminal portions upon certain high current conditions.

DESCRIPTION OF EMBODIMENTS

Figure 1:
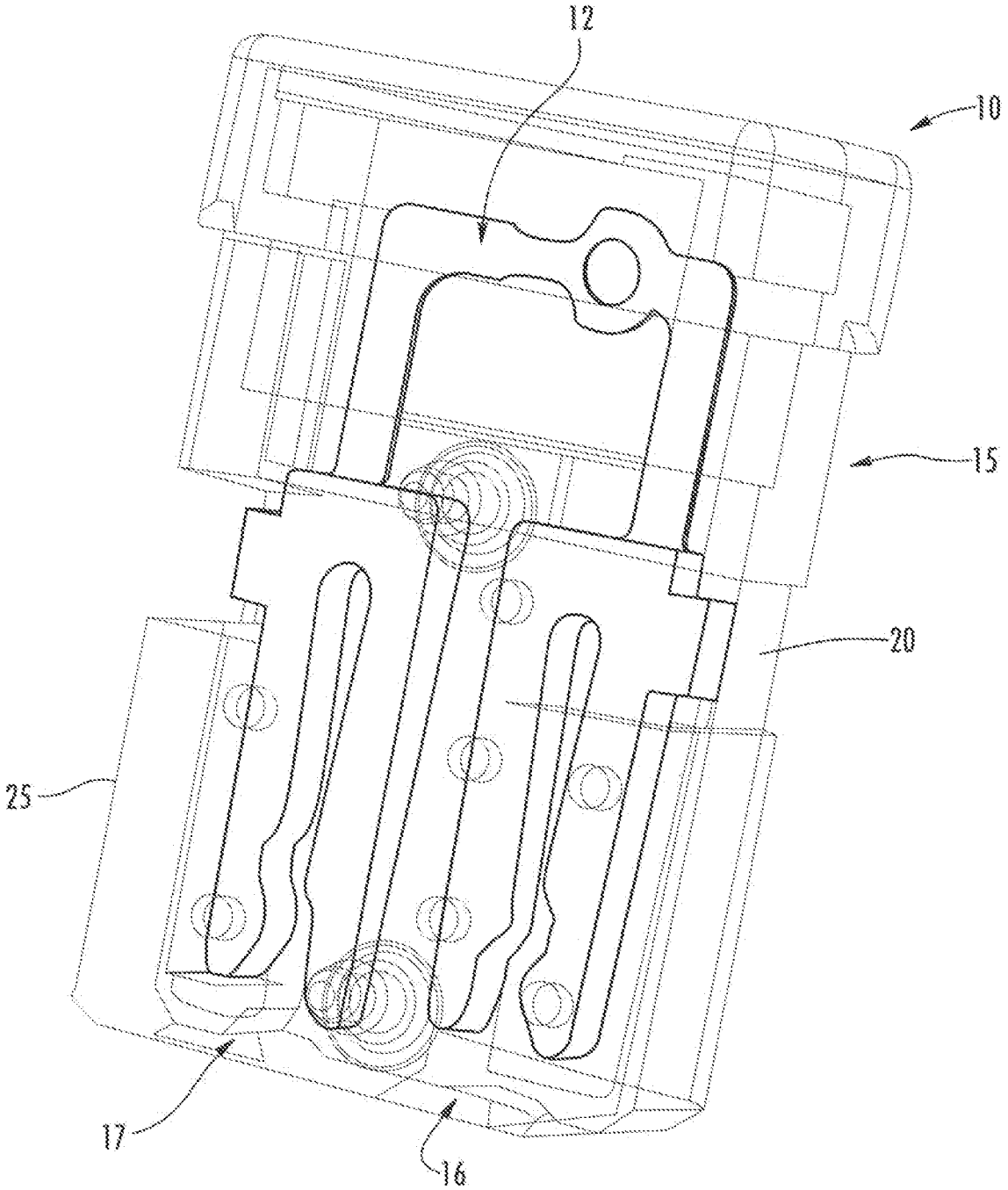
FIG. 1 illustrates a perspective view of a fuse in accordance with an embodiment of the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers to like elements throughout.

FIG. 1. is a perspective view of a fuse 10 having a fusible element 12 positioned within a housing 15. Housing 15 has a generally rectangular or box profile which provides complete enclosure of fusible element 12. Housing 15 comprises a first half 20 and second half 25 (shown transparently for ease of explanation) which may be thermally bonded or force fit together once fusible element 12 is positioned within the housing. Each of the first and second halves 20 and 25 have cut out or aperture portions (as described below) which are aligned such that when the two halves 20 and 25 are joined define a pair of openings 16 and 17 configured to receive terminals during installation.

Figure 2A:
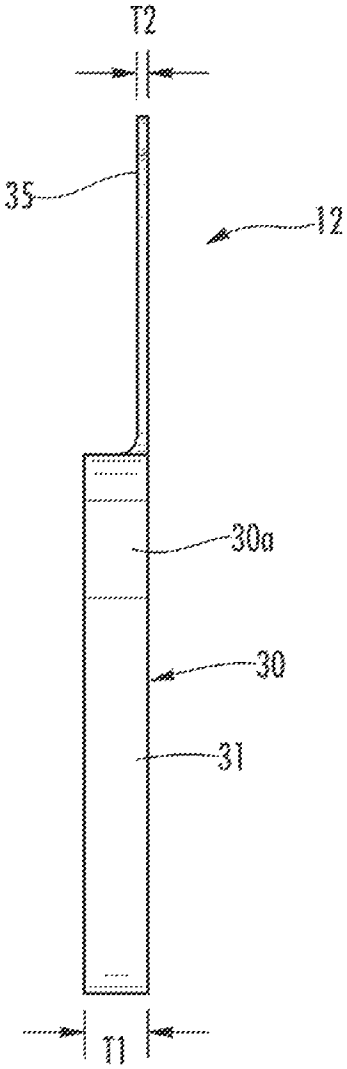
FIG. 2A is a side view illustrating a fusible element in accordance with an embodiment of the present invention.
Figure 2:
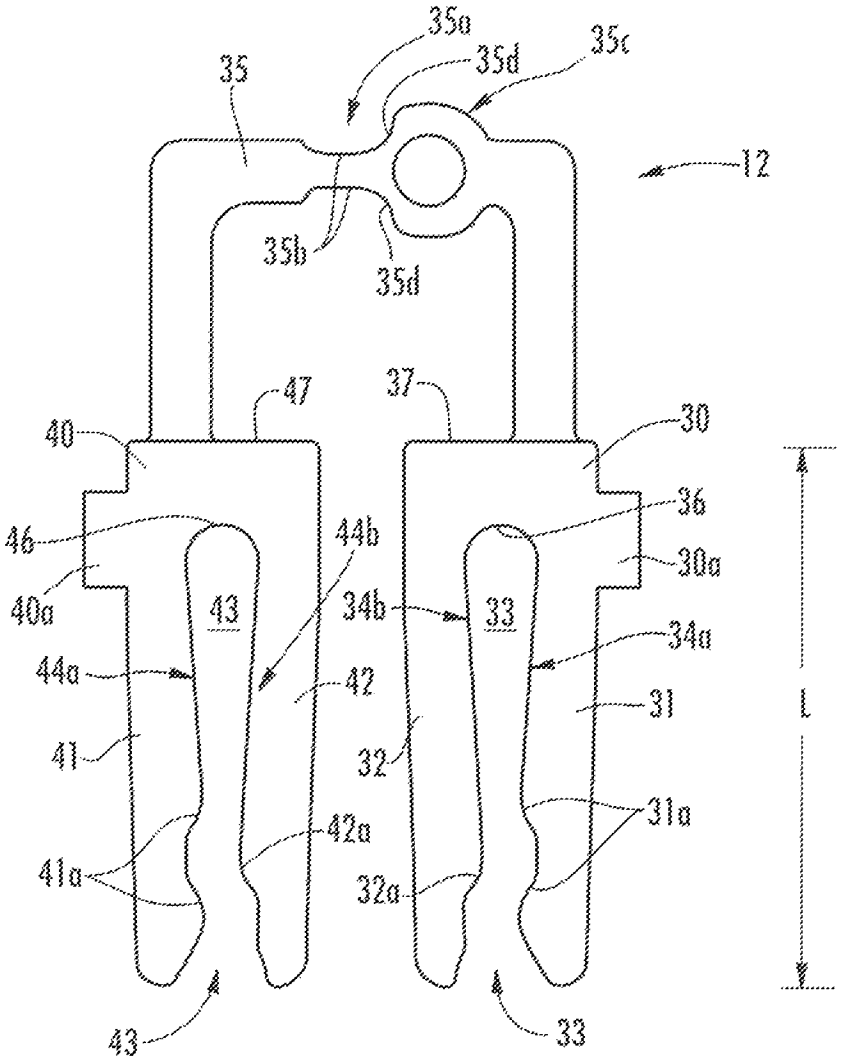
FIG. 2 is a plan view illustrating a fusible element in accordance with an embodiment of the present invention.

FIG. 2 is a plan view of fusible element 12 which includes two terminal portions 30 and 40 having length L and a fusible link portion 35. Fusible element 12 may be made from a copper alloy and manufactured as a single piece and stamped to the desired shape. In particular, fusible link 12 may be formed from a copper alloy having, for example; approximately 97.9% Cu, Sn, 0.1% Fe and 0.03% P or 99.8% Cu, 0.1% Fe and 0.03% P. First terminal portion 30 is defined by a first prong 31 and a second prong 32. Similarly, second terminal portion is defined by a first prong 41 and second prong 42. When an overcurrent condition occurs, fusible link 35 breaks causing an open circuit between terminals 30 and 40. Fusible link 35 includes a bridge section 35*a* having curved portions 35*b* and a diffusion bore section 35*c* similar to the S-shaped fuse link portion 27 as disclosed in U.S. Pat. No. 5,229,739 assigned to the assignee of the present invention the contents of which are incorporated herein by reference. This diffusion bore 35*c* includes a tin pellet which lowers the temperature at which the copper alloy melts. In addition, diffusion bore 35*c* defines a pair of reduced sections 35*d* which are configured to accelerate the tin diffusion effect of the pellet at an overload current condition and lowers the voltage drop readings at the rated current. In particular, when an overcurrent condition occurs, the temperature of fusible link 35 increases to the point where the tin pellet melts and flows into the curved portions 35*b* of bridge section 35*a* and the fuse opens.

Figure 3A:
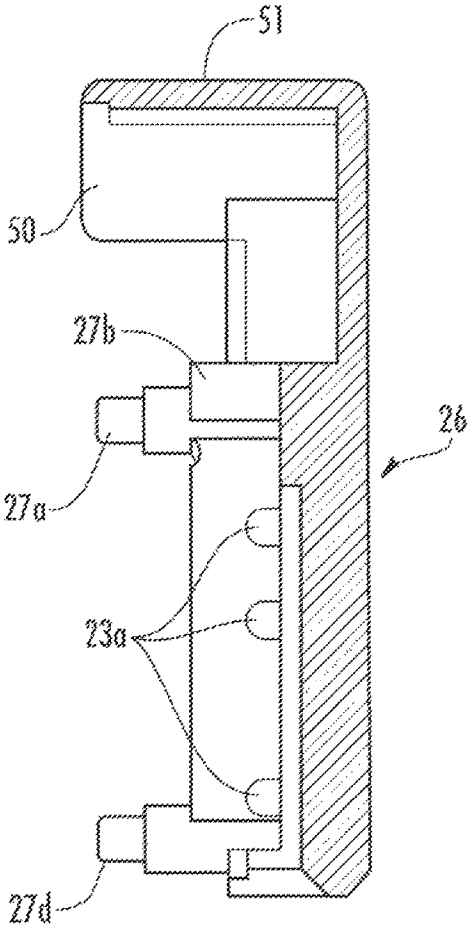
FIG. 3A is a side view of the housing half shown in FIG. 3 taken along lines A-A in accordance with an embodiment of the present invention.
Figure 3:
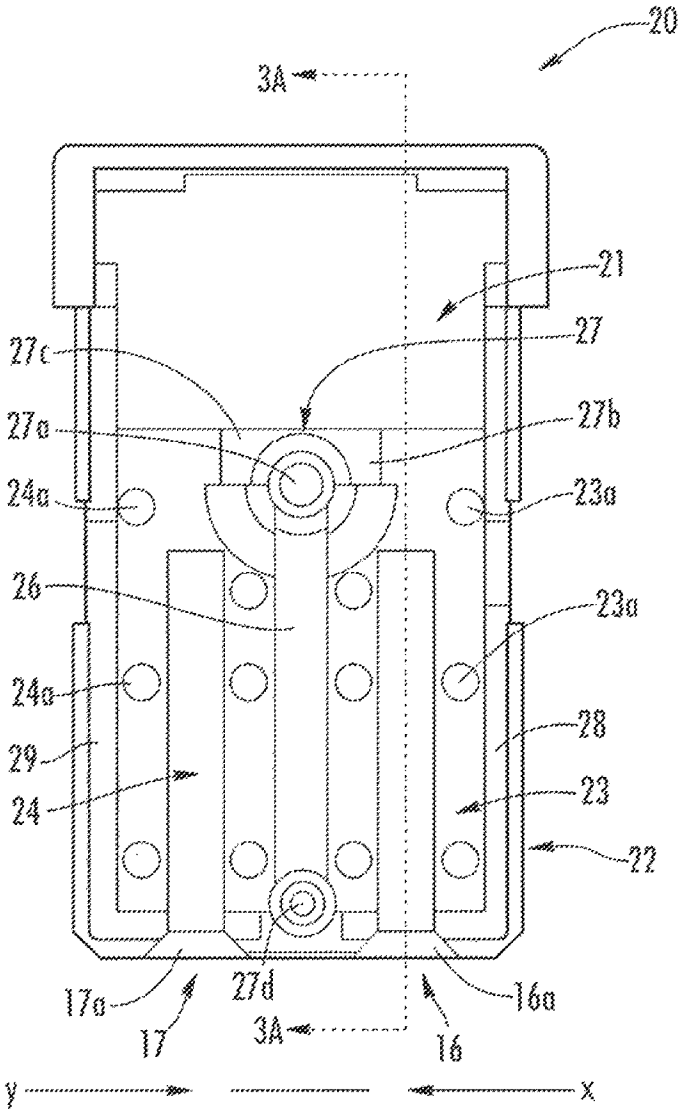
FIG. 3 is a plan view of housing half 20 in accordance with an embodiment of the present invention.

As can be seen, first and second terminals 30 and 40 have a configuration similar to a tuning fork with a retaining portion 37 and 47 used to provide strain relief for the fusible element 12 as described in more detail in FIG. 3. A gap 33 is formed between first prong 31 and second prong 32 of first terminal portion 30 to a rounded portion 36. Gap 43 is formed between first prong 41 and second prong 42 of second terminal portion 40 to a rounded portion 46. Gaps 33 and 43 are configured to receive terminals from a fuse box, fuseholder or panel. First terminal portion 30 includes top and bottom ridges 31*a* on first prong 31 and ridge 32*a* on second prong 32. Second terminal 40 includes top and bottom ridges 41*a* on first prong 41 and ridge 42*a* on second prong 42. Each of these ridges provides electrical contact to terminals inserted in gaps 33 and 43.

Prong 31 of terminal 30 includes an angled wall section 34*a* extending from top ridge 31*a* toward rounded portion 36. Prong 32 of terminal 30 includes angled wall section 34*b* extending from ridge 32*a* toward rounded portion 36. Similarly, prong 41 of terminal 40 includes angled wall section 44*a* extending from top ridge 41*a* toward rounded portion 46. Prong 42 of terminal 40 includes angled wall section 44*b* extending from ridge 42*a* toward rounded portion 46. These angled wall sections 34*a*, 34*b*, 44*a* and 44*b* provide increased material cross sectional area of each of the terminals 30 and 40 of fusible element 12. In addition, the thickness of the material used for the first (31, 41) and second prongs 32, 42) increases the cross sectional area of the fusible element 12 which likewise increases the current capacity. Turning briefly to FIG. 2A which is a side view of fusible element 12, terminal 30 having a thickness T1 and fusible link 35 having a thickness T2. These thicknesses may be configured according to a desired maximum current capability. Fusible element 12 may be manufactured from a single piece of copper alloy which is thinned for fusible link portion 25 and stamped to form terminal portions 30 and 40. Tabs 30*a* and 40*a* connect adjacent fusible elements after stamping which are cut to define individual fusible elements 12 during manufacture. Typical tuning fork terminals have a 30 A current capacity. By utilizing copper alloy material, angled wall sections 34*a*, 34*b*, 44*a* and 44*b* as well as the thickness (T1) to length L of terminal portions 30 and 40, fuse 10 has a current carrying capacity of, for example, approximately 60 A. In this manner, the fuse in accordance with the present invention can replace existing fuse designs with a smaller footprint while providing a larger current carrying capacity.

FIG. 3 is a plan view of housing half 20 having an upper portion 21 and lower portion 22. Upper portion 21 is configured to house fusible link 35 and lower portion 22 is configured to house terminals 30 and 40. Lower portion 22 includes a first chamber 23 within which first terminal 30 of fusible element 12 is positioned. Lower portion 22 also includes a second chamber 24 within which second terminal 40 of fusible element 12 is positioned. First and second chambers are separated by partition 26 which maintains electrical isolation between first terminal 30 and second terminal 40 to prevent shorting therebetween. Cut-out areas 16*a* and 17*a* form half of the openings 16 and 17 for receiving terminals. First chamber 23 includes a plurality of raised bumps 23*a* which support first terminal 30 and second chamber 24 includes a plurality of raised bumps 24*a* which support second terminal 40. A strain relief assembly 27 is disposed between upper portion 21 and lower portion 22 and is integrally formed with partition 26. In particular, strain relief assembly 27 includes a centrally disposed upper post 27*a* and a pair of transversely extending ridges 27*b* and 27*c*. Post 27*a* is aligned with lower post 27*d* at the lower end of partition 26 each of which is used to join housing halves 20 and 25. Ridge 27*b* is contiguous with retaining portion 37 of fusible element 12 and ridge 27*c* is contiguous with retaining portion 47 of fusible element 12 when the fusible element is positioned within housing 15. The positioning of portions 37 and 47 of fusible element 12 against ridges 27*b* and 27*c* provides strain relief for fuse 10. In particular, when terminals are inserted into gaps 33 and 43 (shown in FIG. 2), fusible element 12 is pushed upward in housing 15 such that portions 37 and 47 are forced into ridges 27*b* and 27*c* which maintains fusible element 12 in position. Housing walls 28 and 29 in lower portion 22 prevent first prongs 31 and 41 from separating away from second prongs 32 and 42 respectively. When terminals are inserted into gaps 33 and 43, first prongs 31 and 41 are forced outward toward walls 28 and 29. Wall 28 provides a retention force against prong 31 in direction 'x' and wall 29 provides a retention force against prong 41 in direction 'y'. In this manner, the normal force of the prongs, which is the force of first prongs 31 and 41 toward respective second prongs 32 and 42, is maintained. This normal force provides integrity to the electrical connection between fusible element 12 and the terminals when the terminals are inserted into gaps 33 and 43. FIG. 3A is a side view of housing half 20 taken along lines A-A shown in FIG. 3. Housing half 20 includes an extending side wall 50 and an upper wall 51. Partition wall 26 extends a distance above bumps 23*a*. Posts 27*a* and 27*d* extend above partition wall 26. Ridge 27*b* is approximately at the same height as partition 26, but may have alternative configurations to provide the strain relief function as described above.

Figure 4:
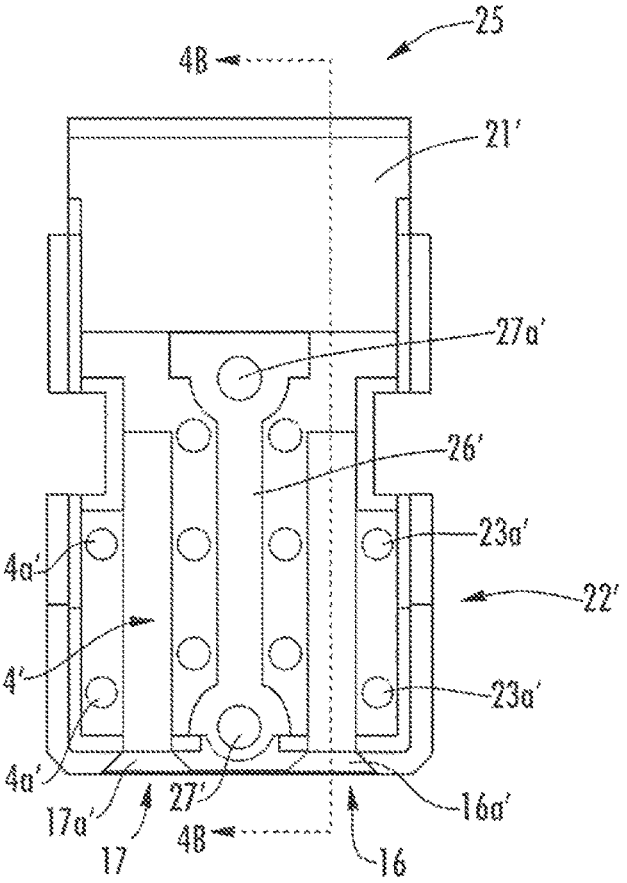
FIG. 4 is a plan view of housing half 25 in accordance with an embodiment of the present invention.
Figure 4B:
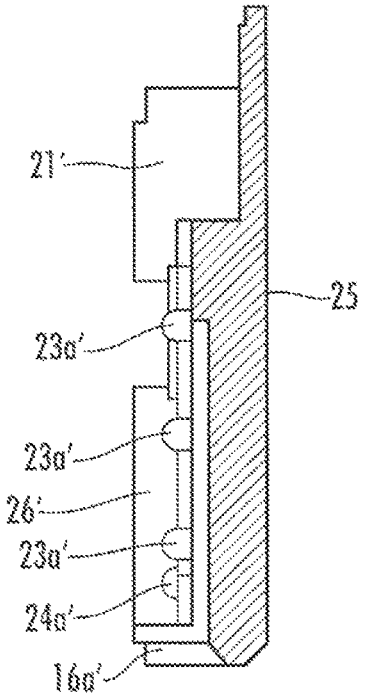
FIG. 4B is a side view of the housing half shown in FIG. 4 taken along lines A-A in accordance with an embodiment of the present invention.
Figure 4A:
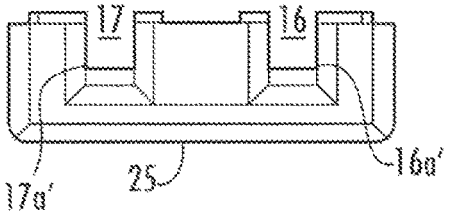
FIG. 4A is a bottom view of housing half 25 shown in FIG. 4 in accordance with an embodiment of the present invention.

FIG. 4 is a plan view of housing half 25 which, when combined with housing half 20, forms housing 15. Housing half 25 includes an upper portion 21' and lower portion 22'. Upper portion 21' of housing half 25 in combination with upper portion 21 of housing half 20 houses fusible link 35; and lower portion 22' of housing half 25 in combination with lower portion 22 of housing half 20, houses terminals 30 and 40. Lower portion 22' includes a first chamber 23' within which first terminal 30 is positioned. Lower portion 22' also includes a second chamber 24' within which second terminal 40 is positioned. First and second chambers are separated by partition 26' which includes a pair of apertures 27*a*' and 27*d*' which receive posts 27*a* and 27*d* of housing half 20. First chamber 23' includes a plurality of raised bumps 23*a*' which support first terminal 30 and second chamber 24' includes a plurality of raised bumps 24*a*' which support second terminal 40. FIG. 4A is a bottom view of housing half 25 in which cut-out areas 16*a*' and 17*a*' align with cut-out areas 16*a* and 17*a* of housing half 20 to define openings 16 and 17 for receiving terminals. FIG. 4B is a side view of housing half 25 taken along lines A-A shown in FIG. 4. Housing half 25 includes upper portion 21', partition wall 26' which extends a distance above bumps 23*a*'. Cut-out area 16*a*' is aligned with first chamber 23' to allow a terminal to enter opening 16 and be disposed between first prong 31 and second prong 32 of terminal 30.

Figure 5:
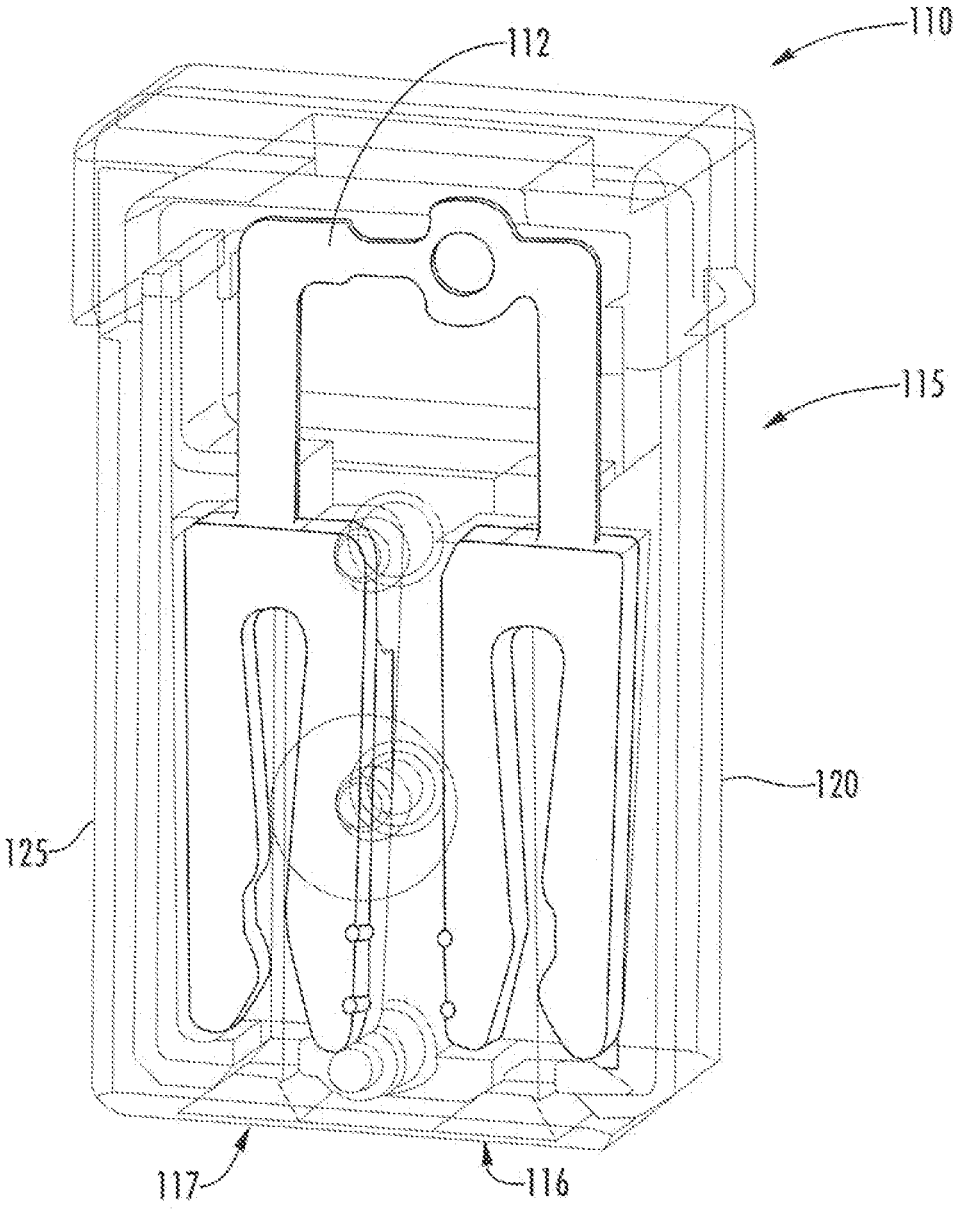
FIG. 5 illustrates a perspective view of a fuse in accordance with an embodiment of the present invention.

FIG. 5. is a perspective view of a fuse 110 having a fusible element 112 positioned within a housing 115. Housing 115 has a generally rectangular or box profile which provides complete enclosure of fusible element 112. Housing 115 is depicted as being clear, but this is for illustrative purposes to show fusible element 112. Housing 115 comprises a first half 120 and second half 125 which may be thermally bonded or force fit together once fusible element 112 is positioned within the housing. Each of the first and second halves 120 and 125 have cut out or aperture portions which are aligned such that when the two halves 120 and 125 are joined define a pair of openings 116 and 117 configured to receive terminals during installation.

Figure 6A:
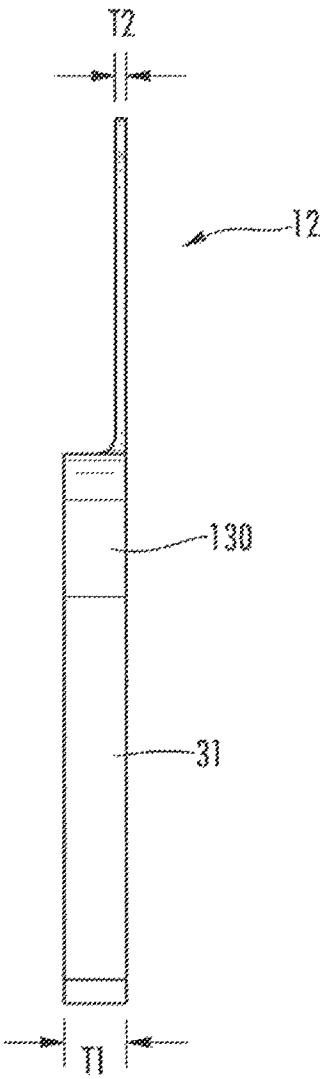
FIG. 6A is a side view illustrating a fusible element in accordance with an embodiment of the present invention.
Figure 6:
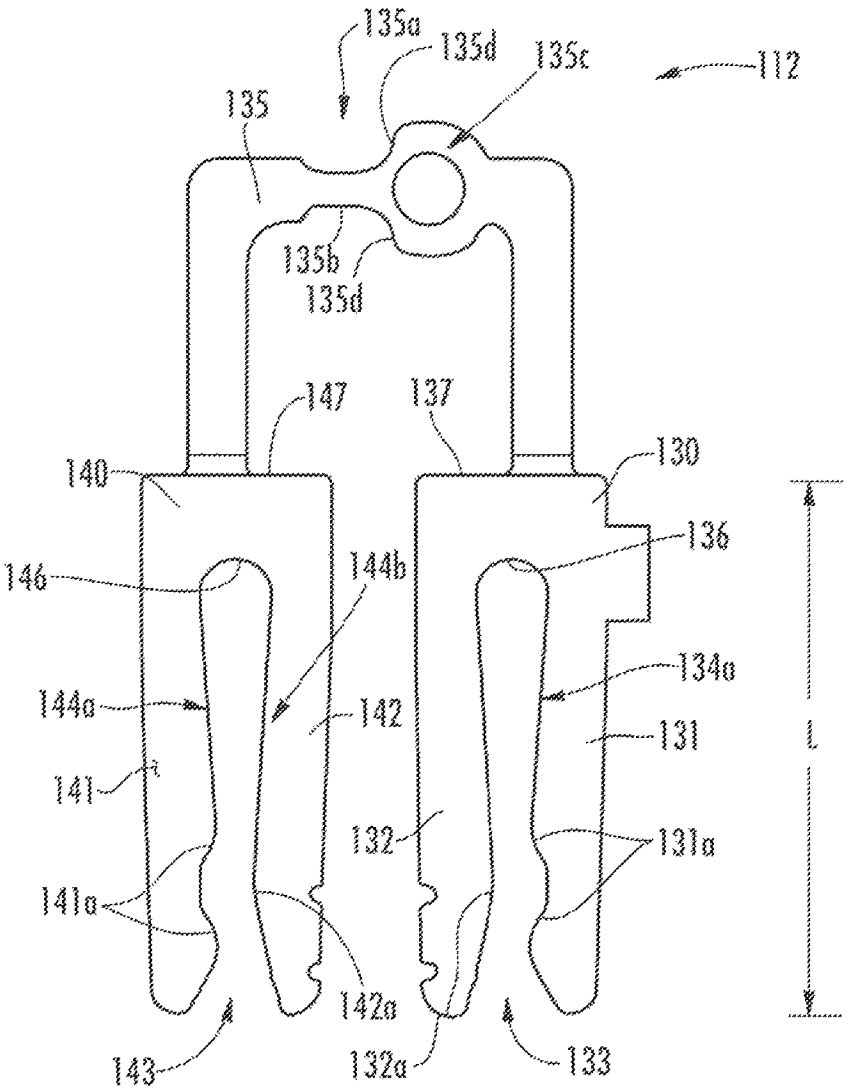
FIG. 6 is a plan view illustrating a fusible element in accordance with an embodiment of the present invention.

FIG. 6 is a plan view of fusible element 112 which includes two terminal portions 130 and 140 having length L and a fusible link portion 135. Similar to fusible element 12 shown in FIG. 2, first terminal portion 130 is defined by a first prong 131 and a second prong 132. Similarly, second terminal portion 140 is defined by a first prong 141 and second prong 142. When an overcurrent condition occurs, fusible link 135 breaks causing an open circuit between terminals 130 and 140. Fusible link 135 includes a bridge section 135*a* having curved portions 135*b* and a diffusion bore section 135*c*. This diffusion bore 135*c* includes a tin pellet which lowers the temperature at which the copper alloy melts. Diffusion bore 135*c* defines a pair of reduced sections 135*d* which are configured to accelerate the tin diffusion effect of the pellet at an overload current condition and lowers the voltage drop readings at the rated current. When an overcurrent condition occurs, the temperature of fusible link 135 increases to the point where the tin pellet melts and flows into the curved portions 135*b* of bridge section 135*a* and the fuse opens.

First and second terminals 130 and 140 have a configuration similar to a tuning fork with a retaining portion 137 and 147 used to provide strain relief for the fusible element 112. A gap 133 is formed between first prong 131 and second prong 132 of first terminal portion 130 to a rounded portion 136. Gap 143 is formed between first prong 141 and second prong 142 of second terminal portion 140 to a rounded portion 146. Gaps 133 and 143 are configured to receive terminals from a fuse box, fuseholder or panel. First terminal portion 130 includes top and bottom ridges 131*a* on first prong 131 and ridge 132*a* on second prong 132. Second terminal 140 includes top and bottom ridges 1141*a* on first prong 141 and ridge 142*a* on second prong 142. Each of these ridges provides electrical contact to terminals inserted in gaps 133 and 143.

Prong 131 of terminal 130 includes an angled wall section 134*a* extending from top ridge 131*a* toward rounded portion 136. Prong 132 of terminal 130 includes angled wall section 134*b* extending from ridge 132*a* toward rounded portion 136. Similarly, prong 141 of terminal 140 includes angled wall section 144*a* extending from top ridge 141*a* toward rounded portion 146. Prong 142 of terminal 140 includes angled wall section 144*b* extending from ridge 142*a* toward rounded portion 146. These angled wall sections 134*a*, 134*b*, 144*a* and 144*b* provide increased material cross sectional area of each of the terminals 130 and 140 of fusible element 112. In addition, the thickness of the material used for the first (131,141) and second prongs (132, 142) increases the cross sectional area of the fusible element 112 which likewise increases the current capacity. Prong 132 of terminal 130 includes a pair of notches toward the lower end of the prong. Similarly, prong 142 of terminal 140 includes a pair of notches toward the lower end of the prong. These notches are the result of removal of bridge material used to support terminals 130 and 140 during the manufacturing process.

FIG. 6A is a side view of fusible element 112, terminal 130 having a thickness T1 and fusible link 135 having a thickness T2. These thicknesses may be configured according to a desired maximum current capability. Fusible element 112 may be manufactured from a single piece of copper alloy which is thinned for fusible link portion 125 and stamped to form terminal portions 130 and 140. Typical tuning fork terminals have a 30 A current capacity. As can be seen, fusible element 112 does not include tab portions (30*a*, 40*a*) shown in FIG. 2. By utilizing copper alloy material, angled wall sections 134*a*, 134*b*, 144*a* and 144*b* as well as the thickness (T1) to length L of terminal portions 130 and 140, fuse 110 has a current carrying capacity of, for example, approximately 60 A. In this manner, the fuse in accordance with the present invention can replace existing fuse designs with a smaller footprint while providing a larger current carrying capacity.

Figure 7A:
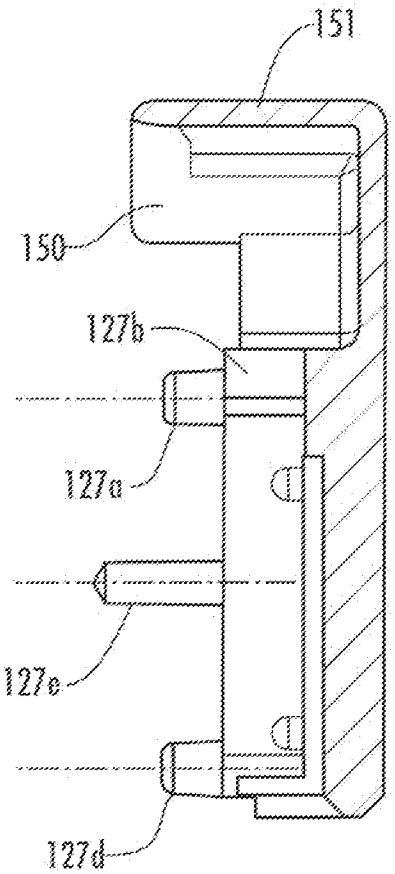
FIG. 7A is a side view of the housing half shown in FIG. 7 taken along lines A-A in accordance with an embodiment of the present invention.
Figure 7:
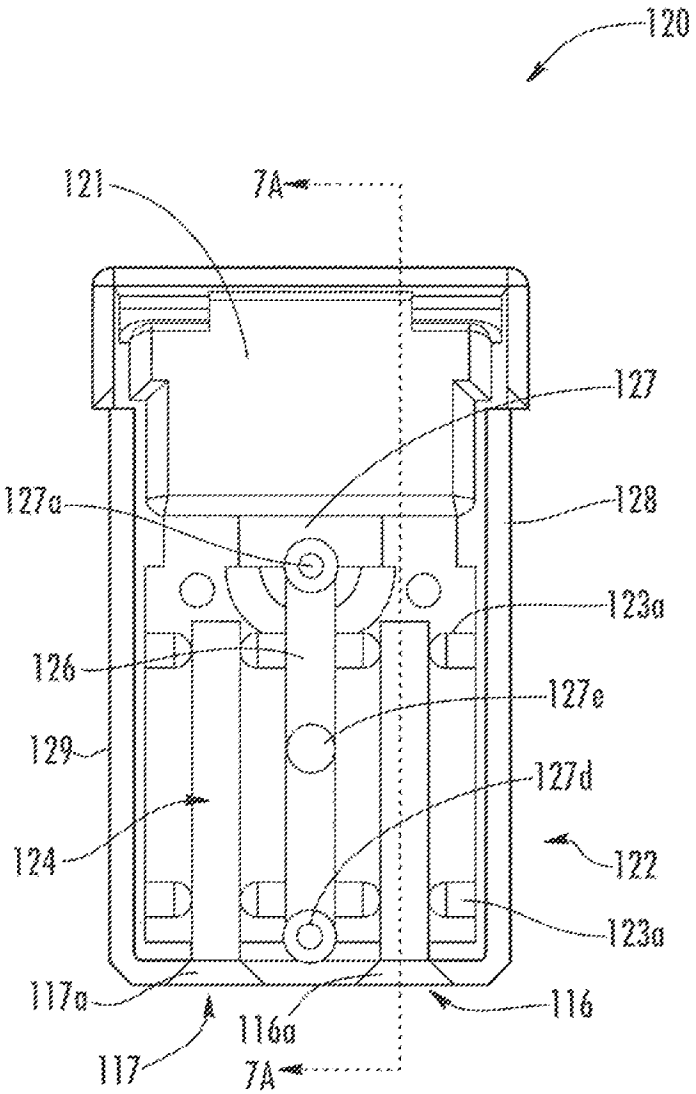
FIG. 7 is a plan view of housing half 120 in accordance with an embodiment of the present invention.

FIG. 7 is a plan view of housing half 120 having an upper portion 121 and lower portion 122. Upper portion 121 of housing half 120 is configured to house fusible link 135 and lower portion 122 is configured to house terminals 130 and 140. Lower portion 22 includes a first chamber 23 within which first terminal 130 of fusible element 112 is positioned. Lower portion 122 also includes a second chamber 124 within which second terminal 140 of fusible element 112 is positioned. First and second chambers are separated by partition 126 which maintains electrical isolation between first terminal 130 and second terminal 140 to prevent shorting therebetween. Cut-out areas 116*a* and 117*a* form half of the openings 116 and 117 for receiving terminals.

When terminals are inserted into gaps 133 and 143, first prongs 131 and 141 are forced outward toward walls 128 and 129. Wall 218 provides a retention force against prong 131 in direction 'x' and wall 129 provides a retention force against prong 141 in direction 'y'. In this manner, the normal force of the prongs, which is the force of first prongs 131 and 141 toward respective second prongs 132 and 142, is maintained. This normal force provides integrity to the electrical connection between fusible element 112 and the terminals when the terminals are inserted into gaps 133 and 143.

Housing half 120 is essentially the same as housing half 20 shown with referenced to FIG. 3. However, housing half 120 includes a fewer number of bumps 123*a*, 124*a* to maintain terminal portions 130, 140 respectively in position within the housing half 120. In particular, bumps 123*a* assist in limiting the amount of contact between terminal portions 130, 140 and housing half 120. In particular, prongs 131, 132 of terminal portion 130 and prongs 141, 142 of terminal portion 140 are disposed in housing half 120. Each of the prongs 131. 132, 141 and 142 are prevented from contacting housing half 120 by bumps 123*a*. This allows air to flow between the fusible element 112 and housing half 120 to provide heat dissipation by limiting the number of contact points between the fusible element 112 and the housing. A strain relief assembly 127 is disposed between upper portion 121 and lower portion 122 and is integrally formed with partition 126. Strain relief assembly 127 is essentially the same as that shown with respect to FIG. 3. However, housing half 120 includes post 127*e* disposed between posts 127*a* and 127*d*.

FIG. 7A is a side view of housing half 120 taken along lines A-A shown in FIG. 7. Housing half 120 includes an extending side wall 150 and an upper wall 151. Partition wall 126 extends a distance above bumps 123*a*. Posts 127*a*, 127*d* and 127*e* extend above partition wall 126. Ridge 127*b* is approximately at the same height as partition 126, but may have alternative configurations to provide the strain relief function as described above.

Figure 8B:
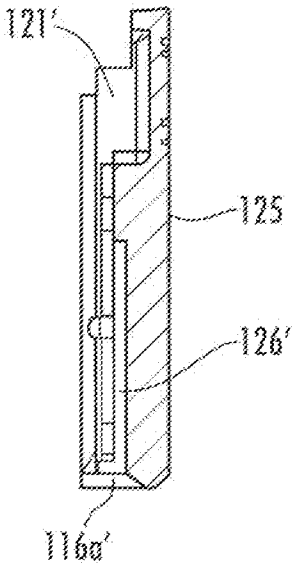
FIG. 8B is a side view of the housing half shown in FIG. 8 taken along lines A-A in accordance with an embodiment of the present invention.
Figure 8A:
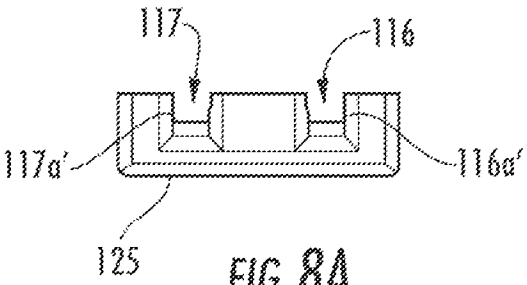
FIG. 8A is a bottom view of housing half 125 shown in FIG. 8 in accordance with an embodiment of the present invention.
Figure 8:
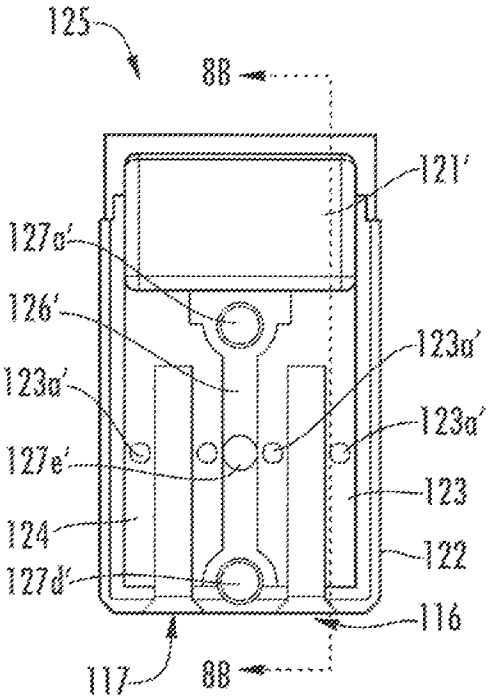
FIG. 8 is a plan view of housing half 125 in accordance with an embodiment of the present invention.

FIG. 8 is a plan view of housing half 125 which, when combined with housing half 120, forms housing 115. Housing half 125 includes an upper portion 121' and lower portion 122'. Upper portion 121' of housing half 25 in combination with upper portion 121 of housing half 120 houses fusible link 135; and lower portion 122' of housing half 125 in combination with lower portion 122 of housing half 120, houses terminals 130 and 140. Lower portion 122' includes a first chamber 123' within which first terminal 130 is positioned. Lower portion 122' also includes a second chamber 124' within which second terminal 140 is positioned. First and second chambers are separated by partition 126' which includes apertures 127*a*', 127*d*' and 127*e*' configured to receive posts 127*a*, 127*d* and 127*e* of housing half 120. First chamber 123' includes a plurality of raised bumps 123*a*' which support first terminal 130 and second chamber 124' includes a plurality of raised bumps 123*a*' which support second terminal 140. Similar to bumps 123*a* shown in FIG. 7, bumps 123*a*' assist in limiting the amount of contact between terminal portions 130, 140 and housing half 112.

FIG. 8A is a bottom view of housing half 125 in which cut-out areas 16*a*' and 117*a*' align with cut-out areas 116*a* and 117*a* of housing half 120 to define openings 116 and 117 for receiving terminals. FIG. 8B is a side view of housing half 125 taken along lines A-A shown in FIG. 8. Housing half 125 includes upper portion 121 ', partition wall 126' which extends a distance above bumps 123*a*'. Cut-out area 116*a*' is aligned with first chamber 123' to allow a terminal to enter opening 116 and be disposed between first prong 131 and second prong 132 of terminal 130.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

We claim:

1. A fuse comprising:

a housing having an upper portion and a lower portion;

a plurality of terminal portions disposed in the lower portion of the housing, each of said terminal portions having first and second prongs and a gap disposed therebetween, wherein the gap narrows from a first width adjacent an upper end of said first and second prongs to a second width adjacent a lower end of said first and second prongs, said gap configured to receive terminals therein; and a fusible link disposed in the upper portion of the housing and between said plurality of terminal portions, said fusible link configured to interrupt current flowing between said plurality of terminal portions upon certain high current conditions; and a partition disposed in said lower portion of said housing, wherein a distance between each of the second prongs and the partition increases from a first end of each of the second prongs proximate the upper portion to a second end of each of the second prongs distal from the upper portion for allowing the second ends to be displaced a distance toward the partition before engaging the partition.

2. The fuse of claim 1 wherein said lower portion comprises a first and second chamber, said first chamber configured to house a first of said plurality of terminal portions and said second chamber configured to house a second of said plurality of terminal portions.

3. The fuse of claim 2 wherein, said partition is configured to maintain electrical isolation between a first terminal portion and said second terminal portion of said plurality of terminal portions.

4. The fuse of claim 3 further comprising a strain relief assembly disposed between said upper portion and said lower portion of said housing, said strain relief assembly being integrally formed with said partition.

5. The fuse of claim 4 wherein said strain relief assembly comprises at least one transversely extending ridge.

6. The fuse of claim 5 wherein each of said plurality of terminal portions comprises a retaining portion, said retaining portion contiguous with said at least one transversely extending ridge to provide strain relief for said fuse when a terminal is inserted into said gap.

7. The fuse of claim 1 wherein said housing is defined by first and second halves.

8. The fuse of claim 7 wherein each of said first and second halves including an upper portion and a lower portion such that when said first and second halves are joined together, said upper portion of said first half and said upper portion of said second half define said upper portion of said housing and said lower portion of said first half and said lower portion of said second half define said lower portion of said housing.

9. The fuse of claim 2 wherein said first chamber includes a raised bump extending from said housing toward one of said plurality of terminal portions to position said terminal portion within said first chamber.

10. The fuse of claim 1 wherein said housing includes a side wall, said side wall configured to provide a strain relief for each of said terminals.

11. The fuse of claim 1 wherein said housing includes a side wall, said side wall configured to provide positioning of said first and second prongs within said lower portion of said housing.

12. A fuse comprising:

a housing having first and second halves and defining an upper portion and a lower portion;

a strain relief assembly centrally disposed within at least said first half; and a fusible member having first and second terminal portions and a fusible link connected between said first and second terminal portions, each of said first and second terminal portions having first and second prongs with a gap disposed therebetween, wherein the gap narrows from a first width adjacent an upper end of said first and second prongs to a second width adjacent a lower end of said first and second prongs, said fusible member disposed within said housing when said first and second halves are coupled together such that an upper portion of each of said first and second first and second terminal portions engages said strain relief assembly when a receiving terminal is inserted into said gap;

a partition disposed in said lower portion of said housing, wherein a distance between each of the second prongs and the partition increases from a first end of each of the second prongs proximate the upper portion to a second end of each of the second prongs distal from the upper portion for allowing the second ends to be displaced a distance toward the partition before engaging the partition.

13. The fuse of claim 12 wherein said first prong includes an upper end, a lower end and an angled wall disposed therebetween, said angled wall configured to provide increased cross-sectional area of said fusible member.

14. The fuse of claim 12 wherein said housing includes a side wall, said side wall configured to provide strain relief for each of said first and second terminal portions.

15. The fuse of claim 12 wherein said housing includes a side wall, said side wall configured to provide positioning of said first and second prongs within said lower portion of said housing.

16. The fuse of claim 12 wherein said first half of said housing includes a raised bump extending from said housing toward said first terminal portion to fixedly position said first terminal portion within said housing.

17. The fuse of claim 12 wherein said first half of said housing includes a raised bump extending from said housing toward said second terminal portion to fixedly position said second terminal portion within said housing.

18. A fuse comprising:

a housing having first and second outside walls and defining an upper portion and a lower portion, and a fusible member having first and second terminal portions and a fusible link connected between said first and second terminal portions, each of said first and second terminal portions having first and second prongs and a gap disposed therebetween, wherein the gap narrows from a first width adjacent an upper end of said first and second prongs to a second width adjacent a lower end of said first and second prongs, said gap configured to receive terminals therein, said fusible member disposed within said housing such that said first prong of each of said terminals engages a respective one of said outside walls when a receiving terminal is inserted into said gap; and a partition disposed in said lower portion of said housing, wherein a distance between each of the second prongs and the partition increases from a first end of each of the second prongs proximate the upper portion to a second end of each of the second prongs distal from the upper portion for allowing the second ends to be displaced a distance toward the partition before engaging the partition.

19. The fuse of claim 18 wherein said housing is defined by a first and second halves and said first and second terminal portions have respective upper portions, said fuse further comprising a strain relief assembly centrally disposed within said first half such that the upper portion of each of said first and second terminal portions engages said strain relief assembly when a receiving terminal is inserted into said gap.

* * * * *